US009250030B2

(12) United States Patent
Henry

(10) Patent No.: US 9,250,030 B2
(45) Date of Patent: Feb. 2, 2016

(54) FIREARM SAFETY SYSTEM

(71) Applicant: David Henry, Irvington, NJ (US)

(72) Inventor: David Henry, Irvington, NJ (US)

( * ) Notice: Subject to any disclaimer, the term of this patent is extended or adjusted under 35 U.S.C. 154(b) by 0 days.

(21) Appl. No.: 14/305,397

(22) Filed: Jun. 16, 2014

(65) Prior Publication Data

US 2014/0366422 A1 Dec. 18, 2014

Related U.S. Application Data

(60) Provisional application No. 61/835,145, filed on Jun. 14, 2013.

(51) Int. Cl.
*F41A 17/06* (2006.01)

(52) U.S. Cl.
CPC ..... *F41A 17/063* (2013.01); *F41A 17/06* (2013.01)

(58) Field of Classification Search
CPC ..... F41A 17/00; F41A 17/06; F41A 17/08; F41A 17/20; F41A 17/22; F41A 17/26; F41A 17/46
USPC ..... 42/70.01–70.11
See application file for complete search history.

(56) References Cited

U.S. PATENT DOCUMENTS

| | | | | |
|---|---|---|---|---|
| 4,682,435 | A | 7/1987 | Heltzel | |
| 5,448,847 | A * | 9/1995 | Teetzel | 42/70.11 |
| 5,564,211 | A | 10/1996 | Mossberg et al. | |
| 5,915,936 | A * | 6/1999 | Brentzel | 42/70.11 |
| 5,946,840 | A * | 9/1999 | Mickel | 42/70.11 |
| 6,286,240 | B1 * | 9/2001 | Collins | 42/70.08 |
| 6,412,207 | B1 | 7/2002 | Crye et al. | |
| 6,415,542 | B1 | 7/2002 | Bates et al. | |
| 6,438,887 | B1 * | 8/2002 | Martin | 42/70.11 |
| 6,735,897 | B1 | 5/2004 | Schmitter et al. | |
| 6,823,621 | B2 * | 11/2004 | Gotfried | 42/70.06 |
| 7,921,588 | B2 * | 4/2011 | Brown et al. | 42/70.01 |
| 8,127,482 | B2 | 3/2012 | O'Shaughnessy et al. | |
| 8,312,660 | B1 * | 11/2012 | Fujisaki | 42/70.11 |
| 8,726,556 | B1 * | 5/2014 | Willingham | 42/70.11 |
| 8,850,733 | B1 * | 10/2014 | Oster | 42/70.01 |
| 2002/0170219 | A1 * | 11/2002 | Martin | 42/70.06 |
| 2002/0178635 | A1 * | 12/2002 | Martin | 42/70.11 |
| 2007/0180749 | A1 | 8/2007 | Schumacher et al. | |
| 2011/0162514 | A1 * | 7/2011 | Osborne et al. | 89/27.12 |
| 2011/0309975 | A1 * | 12/2011 | Chu | 342/357.25 |
| 2012/0180357 | A1 * | 7/2012 | Dietel et al. | 42/70.06 |
| 2014/0173962 | A1 * | 6/2014 | Goren et al. | 42/70.11 |
| 2014/0182179 | A1 * | 7/2014 | McHale | 42/70.06 |
| 2014/0202058 | A1 * | 7/2014 | Zhou | 42/70.11 |
| 2014/0230296 | A1 * | 8/2014 | Kuparinen | 42/1.01 |
| 2014/0250753 | A1 * | 9/2014 | Karmanov Kotliarov et al. | 42/70.11 |
| 2014/0259841 | A1 * | 9/2014 | Carlson | 42/1.01 |
| 2014/0259847 | A1 * | 9/2014 | Medovnikov | 42/70.11 |
| 2014/0298701 | A1 * | 10/2014 | Peng | 42/1.01 |
| 2014/0366421 | A1 * | 12/2014 | Arif et al. | 42/70.11 |
| 2015/0040453 | A1 * | 2/2015 | Ballard et al. | 42/70.11 |

* cited by examiner

*Primary Examiner* — Jonathan C Weber
(74) *Attorney, Agent, or Firm* — Gearhart Law, LLC

(57) ABSTRACT

A firearm safety system as well as a method associated with the firearm safety system capable of preventing a firearm from firing is described. By incorporating a control module into firearms, the presence by the firearm may be detected by a detecting device receiving signals sent by the control module. The detecting device may in turn transmit signals to an established signaling network, such as a mobile telephone network, which may then telecommunicate with the control module to disable the firearm and prevent it from being fired. Such a system and method may be most effective in gun-free zones, especially places such as schools and courthouses. Thus, both the system and the method may be used to reduce firearm violence.

18 Claims, 2 Drawing Sheets

FIREARM SAFETY SYSTEM

CLAIM OF PRIORITY

This application claims priority to U.S. Application Ser. No. 61/835,145 filed on Jun. 14, 2013 the contents of which are herein fully incorporated by reference in its entirety.

FIELD OF THE INVENTION

The current invention relates to a firearm safety system and related methods. In particular, the current invention discloses a firearm safety system and related methods that may be used to detect and disable firearms in a pre-determined safety zone, thus reducing overall gun violence and improving people's safety.

BACKGROUND OF THE INVENTION

Gun violence has become a more and more significant safety problem, not only in the United States, where more than 200 hundred million firearms are privately owned, but also in a number of other countries. A great number of injuries and deaths result from gun-related violence, causing tremendous losses of life and wealth. Tragedies such as the Newtown, Conn. school shooting and other violent incidents are prompting people to seek effective ways to curb firearm misuse and brutality. It is undoubtedly desirable to develop safety systems and control mechanisms that may contribute to the comprehensive endeavor of reducing violence. To achieve such goals, the system is preferred to be effective, simple to use, and wide-ranging. The current invention satisfies that need.

REVIEW OF RELATED TECHNOLOGY

U.S. Pat. No. 8,127,482 pertains to a firearm enabling and disabling electronic system comprising a base unit and a safety device adapted to be incorporated into a fire arm. Each of the base unit and the safety device has a transmitter and/or receiver adapted to exchange and process wireless command signals with each other. The safety device has an actuating circuit which is controlled by the transmitter and/or receiver of the safety device and is adapted to actuate a locking mechanism, wherein in the locking mechanism is operable to prevent a firearm from firing. The wireless command signal is operable within a predetermined distance between the base unit and the safety device so that when the safety device is located within the predetermined distance from the base unit, transmitters and/or receivers exchange the wireless command signal which causes the transmitter and/or receiver of the safety device to prompt the actuating circuit to actuate the locking mechanism thereby causing the locking mechanism to assume a locking mode in which a firearm is prevented from firing.

U.S. Pat. No. 5,524,211 pertains to a firearm, such as a shotgun, that is normally-enabled at all times for firing. An authorized user, such as a police officer, wears a transmitter that transmits signal energy in all directions. The transmitter may be worn by the authorized user on the user's person. The transmitter transmits a "disable" signal that is received by a corresponding signal receiver built into the firearm only when the muzzle of the firearm is pointed in the direction of the authorized user. That is, the receiver has a narrow angular spatial range of signal reception. In this way, if the firearm is taken away from the authorized user, or the authorized user accidentally points the firearm at his/her person, then the firearm will be disabled automatically from firing by reception of the "disable" signal sent by the transmitter worn by the authorized user.

These disclosures, however, are not as complete and effective as the current invention. In summary, various devices are known in the art, but they are distinctively different from the current invention. Moreover, the other inventions fail to address the issues solved by the invention described herein. The embodiments of this invention are illustrated in the accompanying drawings and will be described in more detail herein below.

This application is dedicated to Pierre N. Clervoyant. He was an avid supporter of this system and provided me with any and all assistance necessary to help me move forward the present firearm safety system.

SUMMARY OF THE INVENTION

The current invention discloses a firearm safety system, comprising: a firearm detecting device having detecting device receiver and a detecting device transmitter; and at least one firearm control module having a control module receiver, a control module transmitter, and an actuator; wherein the control modules are affixed to a firearm, the control module transmitter is operable to send firearm signals at fixed intervals, the detecting device receiver is operable to receive and process the firearm signals, the detecting device transmitter is operable to transmit initiation signals to an established signaling network after the detecting device receiver receives and processes the firearm signals; the established signaling network sends disabling signals after receiving the initiation signals, the control module receiver is configured to receive and process the disabling signals and triggers the actuator, and the actuator is operable to prevent the firearm from firing.

It should be noted that the term firearm in the current invention may refer to any kind of weapon that launches one or more projectiles caused by propelling forces of explosives. "Firearm" may include but is not limited to any type of handguns, rifles, shotguns, and automatic weapons such as machine guns. The system disclosed by the current invention may be used to disable firearms in a certain area, preferably in a firearm specific manner. Many violent events may be prevented if the perpetrator was unable to fire his/her firearm when he/she is in a zone equipped with the current system.

Therefore, the current invention discloses a method to reduce firearm violence, comprising the steps of: detecting a firearm in a pre-determined safety zone by receiving firearm signals sent by a control module transmitter affixed to the firearm; transmitting initiating signals to an established signaling network; the established signaling network sending disabling signals to a control module receiver affixed to the firearm; the control module receiver triggering an actuator to prevent the firearm from firing.

The system and method disclosed by the current invention may comprise further variations that provide more flexibility and effectiveness. For example, the range of the safety zone may be determined by a distance between the control module and the detecting device. Alternatively, the safety zone may be limited by setting signal-absorbing materials at the boundary. In addition, the actuator may act upon any part of the firearm that may prevent the firearm from being fired. In particular, the actuator may include a firearm safety catch blocker that limits the engagement of the safety catch.

All kinds of technologies may be used to materialize the basic design of the current system and method. For example, the communication between the firearm control module and the firearm detecting device may be achieved by radio frequency identification (RFID) or Bluetooth® technologies. The established signaling network may be a mobile network including base stations and cellular radio towers. Alternatively, the established signaling network may be a radio telecommunication network.

Besides disabling firearms that enter a specific safety zone, which is a defensive approach to reduce violence, proactive steps may be taken to improve the results. For example, the method herein disclosed may include notifying law enforcement authorities after the control module receiver triggers an actuator to prevent the firearm from firing. The involvement of law enforcement authorities may make the anti-violence efforts more effective.

In general, the present invention succeeds in conferring at least the following desirable and useful benefits and objectives.

It is an object of the present invention to provide a firearm safety system and method that can reduce firearm-related violence.

It is an object of the present invention to provide a firearm safety system that allows detections of firearms in specific safety zones.

It is an object of the present invention to provide a firearm safety system that includes a receiving device capable of detecting firearms incorporating a control module.

It is an object of the present invention to provide a firearm safety system that includes control modules that are affixed to firearms.

It is an object of the present invention to provide a firearm safety system that may send signals to established communication networks.

It is another object of the current invention to provide a firearm safety system that distinguishes between different kinds of control modules.

It is another object of the current invention to provide a firearm safety system that is capable of notifying law enforcement authorities after detecting a firearm in the pre-determined safety zone.

It is still another object of the current invention to provide a firearm safety system that includes a receiving device that is portable and easy to carry around.

It is another object of the current invention to provide a firearm safety system that is inexpensive.

It is yet another object of the current invention to provide a firearm safety system that includes a receiving device that may disable a plurality of firearms.

It is yet another object of the current invention to provide a firearm safety system that is easy to use and easy to manufacture.

It is yet another object of the current invention to provide a firearm safety system that permits for the location tracking of a misplaced, lost, or stolen firearm.

DESCRIPTION OF THE PREFERRED EMBODIMENTS

Figure 1:
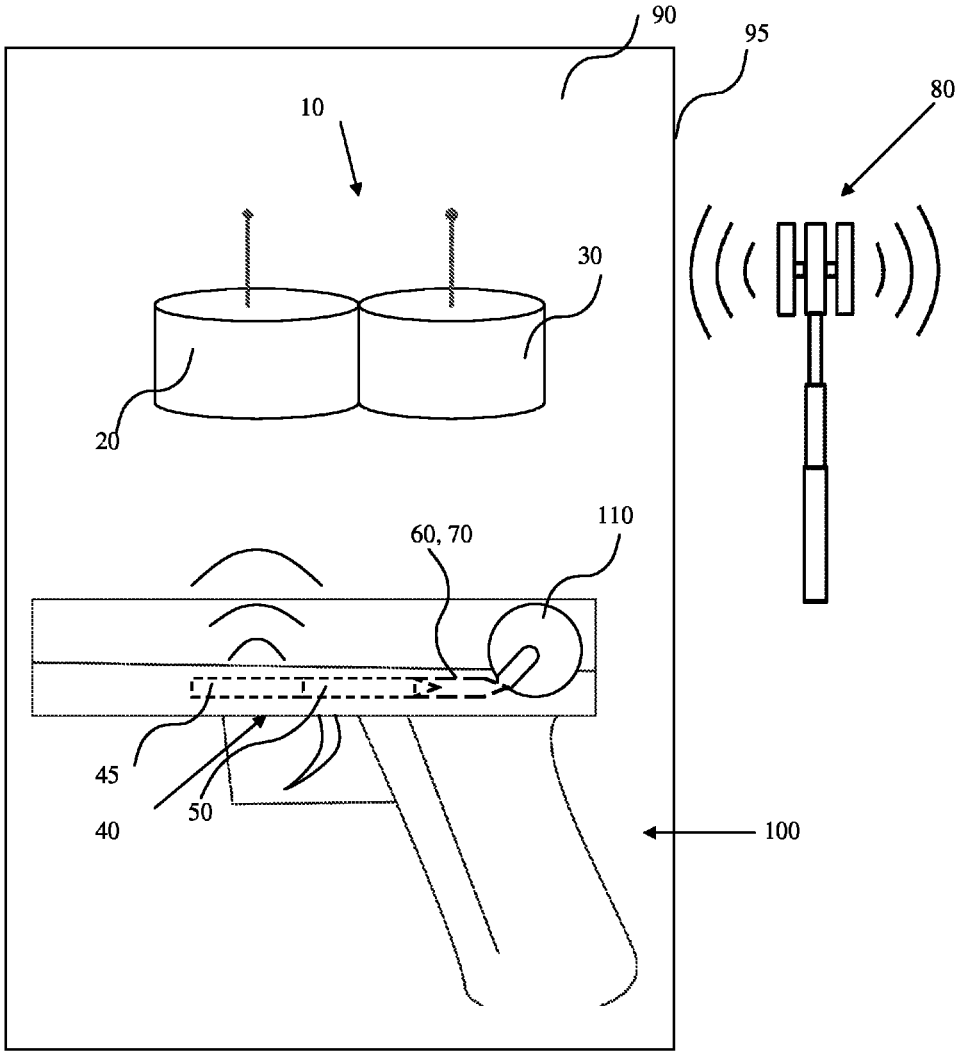
FIG. 1 shows a schematic illustration of a firearm safety system of the current invention.

The preferred embodiments of the present invention will now be described with reference to the drawings. Identical elements in the various figures are identified, as far as possible, with the same reference numerals. Reference will now be made in detail to embodiments of the present invention. Such embodiments are provided by way of explanation of the present invention, which is not intended to be limited thereto. In fact, those of ordinary skill in the art may appreciate upon reading the present specification and viewing the present drawings that various modifications and variations can be made thereto without deviating from the innovative concepts of the invention.

FIG. 1 shows a schematic illustration of a firearm safety system of the current invention. Shown in FIG. 1 is the firearm safety system comprising: a firearm detecting device 10 including a detecting device receiver 20 and a detecting device transmitter 30; a firearm control module 40 including a control module transmitter 45, a control module receiver 50, and an actuator 60, wherein the control module 40 is affixed to a firearm 100, and the actuator 60 includes a safety catch blocker 70 that engages a firearm safety catch 110, allowing the actuator 60 to prevent the firearm 100 from firing. The firearm detecting device 10 is capable of detecting the firearm 100 when the firearm 100 and the control module 40 are in a safety zone 90 surrounded by safety zone border 95. The firearm safety system is capable of communicating with an established signaling network 80.

Figure 2:
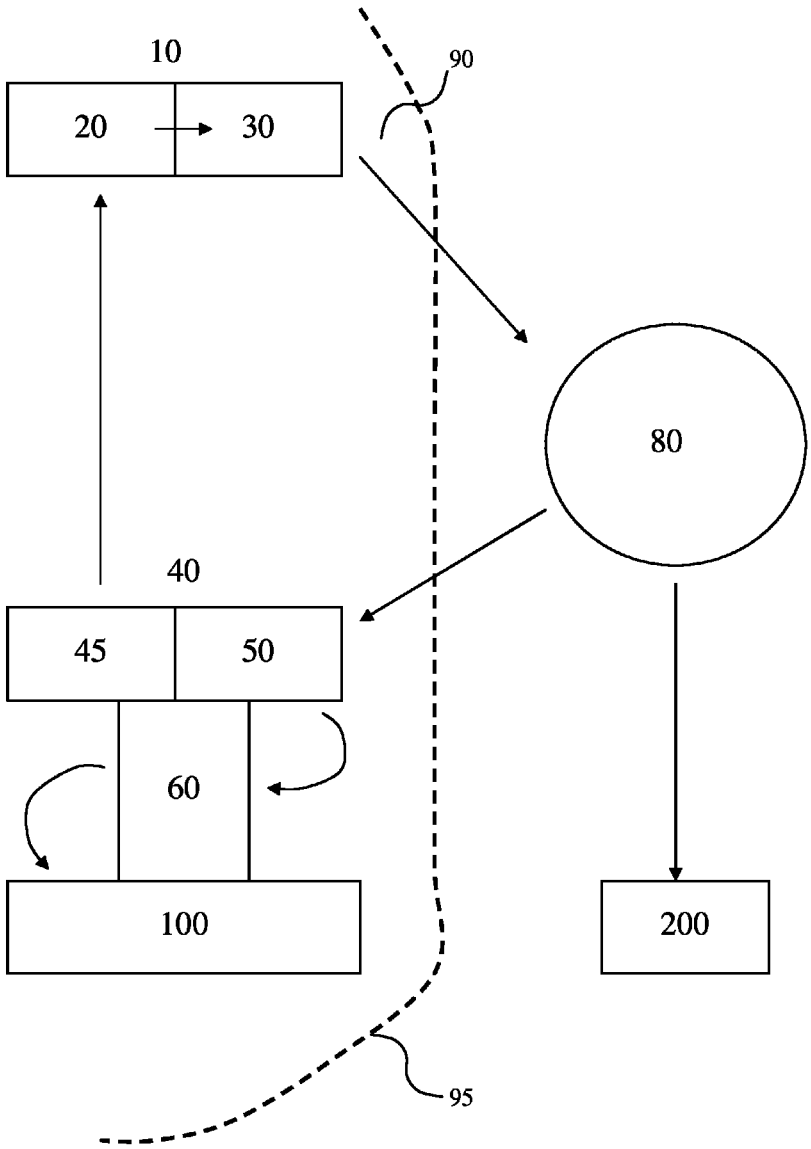
FIG. 2 shows a schematic illustration to demonstrate how the firearm safety system works.

FIG. 2 shows a schematic illustration to demonstrate how the firearm safety system works. Shown in FIG. 2 is the firearm safety system comprising: a firearm detecting device 10 including a detecting device receiver 20 and a detecting device transmitter 30; a firearm control module 40 including a control module transmitter 45, a control module receiver 50, and an actuator 60, wherein the control module 40 is affixed to a firearm 100, and the actuator 60 is capable of preventing the firearm 100 from firing. The firearm detecting device 10 is capable of detecting the firearm 100 when the firearm 100 and the control module 40 are in a safety zone 90 surrounded by safety zone border 95. The firearm safety system is capable of communicating with an established signaling network 80, which may, in turn, send a signal to the control module receiver 50 and notify law enforcement authorities 200. The arrows indicate the transmission of signaling between the various components of the firearm safety system and between the firearm safety system and external elements.

As shown in FIGS. 1 and 2, the control module 40 is physically affixed to a firearm 100, providing real-time positioning of the firearm 100. The control module transmitter 45 may send out signals that may be detected by the detecting device receiver 20 when the control module 40, and thus the firearm 100, are in a safety zone 90 surrounded by a safety zone boundary 95. The control module transmitter 45 may send out signals in a continuous manner or in intervals. If the signals are sent out in intervals, the intervals are preferred to be short, e.g. less than 5 seconds, ensuring that the firearm 100 is detected in a timely manner.

The detecting device receiver 20 and the detecting device transmitter 30 are closely associated. Although FIG. 1 shows the two structures as distinct components of the detecting device 10, it should be noted that the detecting device receiver 20 and the detecting device transmitter 30 may be integrated into a single unit with dual functions.

Referring to FIGS. 1 and 2, the control module transmitter 45 and the detecting device receiver 20 are the essential components for the detection of the firearm 100. The transmitter-receiver communication may be implemented by any kind of technology that can serve the basic goals of the current invention. Such technology may include but not be limited to the Bluetooth® wireless communication and the radio frequency identification (RFID) systems.

The control module transmitter 45 and detecting device receiver 20 may, for instance, be a lock and key pair of active Radio Frequency Identification (RFID) tags, such as, but not limited to, the lock and key tag pairs TWN400 and TWR400 made by WINLAB, of North Brunswick, N.J. These transmit and receive in the 2.45 GHz frequency band using Gaussian Frequency-Shift Keying (GFSK), i.e. frequency shift keying in which the signal is smoothed by a Gaussian filter before transmission. This is the same encoding used in Bluetooth® devices.

Referring to FIGS. 1 and 2, as soon as the detecting device receiver 20 detects the presence of the firearm 100 in the safety zone 90, the detecting device transmitter 30 is prompted to send out signals that may reach an established signaling network 80, as shown in FIG. 2, triggering a series of subsequent actions.

The established signaling network 80 may be any kind of network that has already been set up for private or public use and that is capable of wide-range wireless communications. Preferably, the established signaling network 80 is a cellular network that distributed over land areas with each served by at least one fixed-location transceiver. The cellular network may use any kind of digital cellular technologies, including but not limited to: Global System for Mobile Communications (GSM), General Packet Radio Service (GPRS), CDMA One, CDMA 2000, Evolution-Data Optimized (EV-DO), Enhanced Data Rates for GSM Evolution (EDGE), Universal Mobile Telecommunications System (UMTS), Digital Enhanced Cordless Telecommunications (DECT), Digital AMPS (IS-136/TDMA), and Integrated Digital Enhanced Network (iDEN). Alternatively, the established signaling network 80 may employ radio or television signaling or satellite communication networks. Using established signaling networks lowers the cost for the firearm safety system. Most importantly, the established signaling networks are generally more reliable and the signaling is more stable, reducing the chances of malfunction of the firearm safety system.

Further, the present invention may take advantage of the above described and other established signaling networks 80, namely global positioning systems. The detecting device transmitter 30 may be capable of emitting a signal that can be received by at least one of the satellites comprising the current and future global positioning system(s) (GPS). The detecting device transmitter 30 may constantly emit such a signal or may only send a signal under certain conditions (i.e. the safety has been disengaged) attributable to a firearm 100. Thus, once such a signal is emitted from the detecting device transmitter 30 or comparable device, the GPS can triangulate or otherwise calculate the location of the firearm 100. This, in turn, enables an entity to closely monitor the location and movements of a particular firearm 100.

The GPS also allows for the assistance in finding lost, misplaced, or stolen firearms. The benefits in such a scenario are numerous as stolen firearms are often used to commit other crimes and it prevents lost items from falling into the wrong hands. Preferably, the firearm 100 can be tracked and located as to prevent others from finding it or the firearm being used to commit a crime. It may be preferable to require a reset detecting device transmitter 30 when activated. This prevents a lost or stolen firearm from having its location tracking blocked by a deactivation of the detecting device transmitter 30. The reset may be required to be performed by a law enforcement or other official with appropriate credentials to perform the reset upon ascertaining proper ownership. Further, during this time of activation of the GPS, the firearm is also prevented from firing in accordance with the firearm safety system and methodology as described.

As shown in FIGS. 1 and 2, after receiving signals from the control module transmitter 45, the established signaling network 80 may communicate with the control module receiver 50, which may in turn set the actuator 60 in motion to disable the firearm 100. The recognition of the specific control module may be achieved by any technology. In particular, similar to cell phone recognition, each control module 40 may be assigned a mobile subscriber identity number, which is usually 15-16 digits. The technology is known in the art and may be implemented to achieve the goal of disabling single firearm 100.

The actuator 60 may take any form as long as it can prevent the firearm 100 from firing. In particular, the actuator 60 may include a firearm safety catch blocker 70 that limits the engagement of the firearm safety catch 110, preventing the firearm 100 from being fired. Alternatively, the actuator 60 may comprise mechanisms that block the firearm trigger or the loading of ammunition. In general, the actuator 60, as a component of the control module 40, may be initiated and disarmed by the control module receiver 50.

Referring to FIGS. 1 and 2, it is preferred that the firearm safety system is effective within a certain safety zone 90. Such safety zone may be any property or locale that requires or needs protection from firearm related violence. For example, the safety zone may be a school or a public building such as a courthouse or municipality complex. The safety zone may also be a private home or a business property. The possible entities that desire protection from gun violence may very well be limitless.

The range of the safety zone 90 may be simply set by the capacity of signaling between the control module transmitter 45 and the detecting device receiver 20. Such capacity may be determined by a number of factors, among which the most crucial and universal is probably the distance between the control module transmitter 45 and the detecting device receiver 20. Preferably, such a distance may range between 1 to 10,000 meters. The owner or manager of the safety zone may adjust other parameters such as the power of the transmitter to fit the size of the property, ensuring full detection and reducing false alarms. Alternatively, the range of the safety zone may be controlled by adding signal-blocking or signal-absorbing material to the boundary of the safety zone. Such an approach may be more expensive but enhances the flexible use of the safety system.

Referring to FIG. 2, besides disabling the firearm 100, through the established signaling network 80, the user of the firearm safety system may also inform law enforcement authorities 200, allowing timely response by law enforcement personnel and further prevention of violence. Such a feature may be automatic or may require the additional set up of the user of the firearm safety system.

The current invention, if used effectively, may significantly reduce firearm related violence. By implementing the control module in the firearms and positioning the detecting device in the safety zone, the presence of the firearm may be promptly detected and the firearm may be timely disabled to prevent violence. In such a manner, schools, public buildings and private properties may be protected. It is preferred that firearms of law enforcement authorities do not incorporate the control module, allowing law enforcement personnel to use their firearms in the safety zone to prevent violence. Alternatively, different types of control modules may be implemented in different firearms, whereas the detecting device is capable of detecting, distinguishing, and disabling some or all of the firearms by communicating with some or all of the control modules. The choices are limitless and one skilled in the art could understand that all approaches are encompassed by the spirit of the current invention.

Although this invention has been described with a certain degree of particularity, it is to be understood that the present disclosure has been made only by way of illustration and that numerous changes in the details of construction and arrangement of parts may be resorted to without departing from the spirit and the scope of the invention.

What is claimed is:

1. A firearm safety system, comprising:

a firearm detecting device having a detecting device receiver and a detecting device transmitter;

a firearm disabling signal absorbing material positioned around a perimeter of a property thereby defining a boundary of a safety zone; and at least one firearm control module having an electronic identification number, the at least one firearm control module comprising a control module receiver, a control module transmitter, and an actuator;

wherein the at least one control module is disposed in a frame member of a firearm longitudinally below a barrel of the firearm, the control module transmitter is operable to send firearm signals at fixed intervals, the detecting device receiver is operable to receive and process the firearm signals, the detecting device transmitter is operable to transmit initiation signals to an established signaling network after the detecting device receiver receives and processes the firearm signals, the established signaling network sends disabling signals after receiving the initiation signals, the control module receiver is configured to receive and process the disabling signals and triggers the actuator, and the actuator is configured to slidably engage a firearm safety catch thereby preventing the firearm from firing.

2. The firearm safety system of claim 1, wherein:

the firearm signals are limited to a pre-determined safety zone.

3. The firearm safety system of claim 2, wherein:

the range of the safety zone is determined by a distance between the control module and the firearm detecting device.

4. The firearm safety system of claim 1, wherein:

the longest fixed interval is less than one second.

5. The firearm safety system of claim 1, wherein:

the established signaling network is a mobile network.

6. The firearm safety system of claim 1, wherein:

the established signaling network is a telecommunication network.

7. The firearm safety system of claim 1, wherein the control module further comprises:

a power source connected to the control module transmitter and the actuator.

8. The firearm safety system of claim 1, wherein the established signaling network is a global positioning system (GPS).

9. The firearm safety system of claim 8 wherein the GPS is activated in the event of a lost, stolen, or misplaced firearm.

10. A method to reduce firearm violence, comprising the steps of:

adjusting parameters of a safety zone to limit a firearm disabling signal transmission to boundaries of a property, wherein a firearm disabling signal absorbing material is positioned around a perimeter of the property thereby defining a boundary of the safety zone;

detecting a firearm in the safety zone by receiving firearm signals sent by a control module transmitter affixed to the firearm;

transmitting initiating signals to an established signaling network;

sending the firearm disabling signals from the established signaling network to a module receiver affixed to the firearm;

triggering an actuator attached to the module receiver to engage a safety catch of the firearm thereby preventing the firearm from firing.

11. The method of claim 10, wherein:

the control module transmitter is operable to send firearm signals at fixed intervals.

12. The method of claim 10, wherein:

the control module transmitter, the control module receiver, and the actuator are incorporated in a control module.

13. The method of claim 10, wherein:

the range of the safety zone is determined by a distance between the control module and the detecting device.

14. The method of claim 10, wherein:

the initiating signals are transmitted by a detecting device transmitter.

15. The method of claim 10, wherein:

the established signaling network is a mobile network.

16. The method of claim 10, further comprising:

notifying law enforcement authorities after the control module receiver triggers an actuator to prevent the firearm from firing.

17. The method of claim 10, wherein the established signaling network is a global positioning system (GPS).

18. The method of claim 10, further comprising:

resetting a detecting device transmitter of the safety zone, wherein the detecting device transmitter is reset from an activated state to a monitoring state using authoritative credentials.

* * * * *